US008535077B2

(12) United States Patent
Shen et al.

(10) Patent No.: US 8,535,077 B2
(45) Date of Patent: Sep. 17, 2013

(54) CARD EDGE CONNECTOR

(75) Inventors: Xue-Hai Shen, Kunshan (CN); Zhuang-Xing Li, Kunshan (CN); Wen-Jun Tang, Kunshan (CN); Xue-Wu Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/331,373

(22) Filed: Dec. 20, 2011

(65) Prior Publication Data

US 2012/0156912 A1 Jun. 21, 2012

(51) Int. Cl.
*H01R 13/62* (2006.01)

(52) U.S. Cl.
USPC ..... 439/328; 439/160

(58) Field of Classification Search
USPC ..... 439/152, 153, 155, 157, 160, 327, 439/328
See application file for complete search history.

(56) References Cited

U.S. PATENT DOCUMENTS 3,188,598 A * 6/1965 Pferd ..... 439/59
3,731,252 A * 5/1973 McKeown et al. ..... 439/59
4,129,351 A * 12/1978 Sugimoto et al. ..... 439/325
4,487,468 A * 12/1984 Fedder et al. ..... 439/325
4,548,456 A * 10/1985 Robertson ..... 439/373
5,211,568 A * 5/1993 Yamada et al. ..... 439/157
5,389,000 A * 2/1995 DiViesti et al. ..... 439/157
5,660,557 A * 8/1997 Lemke et al. ..... 439/328
5,980,282 A * 11/1999 Cheng ..... 439/157
7,666,011 B2 2/2010 Lim et al.
7,985,087 B2 * 7/2011 Li et al. ..... 439/157
8,002,563 B2 * 8/2011 Li et al. ..... 439/160
8,157,576 B2 * 4/2012 Fu et al. ..... 439/153

* cited by examiner

*Primary Examiner* — Neil Abrams
*Assistant Examiner* — Travis Chambers
(74) *Attorney, Agent, or Firm* — Wei Te Chung; Ming Chieh Chang

(57) ABSTRACT

A card edge connector for mating with a corresponding daughter card 200 with a locking notch 201 at a side thereof, comprises: an insulative housing 1, a plurality of contacts 2 assembled to the insulative housing 1 and an ejector 3 and a locking member 4 set on two longitudinal ends of the insulative housing 1. The insulative housing defines a central slot 14 along the longitudinal direction. The locking member 4 is formed with a retention portion 41 and a pair of elastic arms 42 extending upwardly from the retention portion 41 and symmetrically located on two opposite sides of the central slot along a transverse direction perpendicular to longitudinal direction, each elastic arm 42 having a locking portion 321 protruding toward each other for locking with the locking notch 201 of the daughter card 200.

17 Claims, 10 Drawing Sheets

CARD EDGE CONNECTOR

BACKGROUND OF THE INVENTION

1. Field of the Invention

The present invention generally relates to a card edge connector for receiving a daughter card.

2. Description of Related Art

U.S. Pat. No. 7,666,011, issued on Feb. 23, 2010, discloses a related card edge connector which is adapted for mounting a daughter card. The card edge connector includes an insulative housing, a plurality of contacts received in the insulative housing and a locking member mounted on an end of the insulative housing. The locking member has two stacked locking elastic pieces, and each elastic piece has a clamping portion and a positing arm, and each clamping portion overlaps with one positing arm along a left-to-right direction, the clamping portions are used to clamp the daughter card and are symmetrical disposed. However, the locking member need two stacked locking elastic pieces to enhance an intensity thereof, but that also complexes the configuration. Furthermore, both ends of the card edge connector are assembled with the locking elastic pieces, so people must use another detaching tool to withdraw the daughter card received in the card edge connector.

Hence, an improved card edge connector is desired to overcome the above problems.

SUMMARY OF THE INVENTION

According to one aspect of the present invention, a card edge connector, adapted for receiving a daughter card with a locking notch, comprises a longitudinal insulative housing, a plurality of contacts retained into the insulative housing, an ejector and a locking member. The insulative housing defines a central slot for receiving the daughter card and has two towers located on two longitudinal ends of the insulative housing, and the contacts have contact portions protruding into the central slot. The ejector is assembled to one tower of the insulative housing and has an ejecting portion for withdrawing the daughter card received in the central slot; and the locking member is set on the other one tower, the locking member is formed with a retention portion interfering with the insulative housing and a pair of elastic arms extending upwardly from the retention portion and symmetrically located on two opposite sides of the central slot along a transverse direction perpendicular to longitudinal direction. Each elastic arm has a locking portion protruding toward each other, and a gap between the locking portions being smaller than a thickness of the daughter card.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
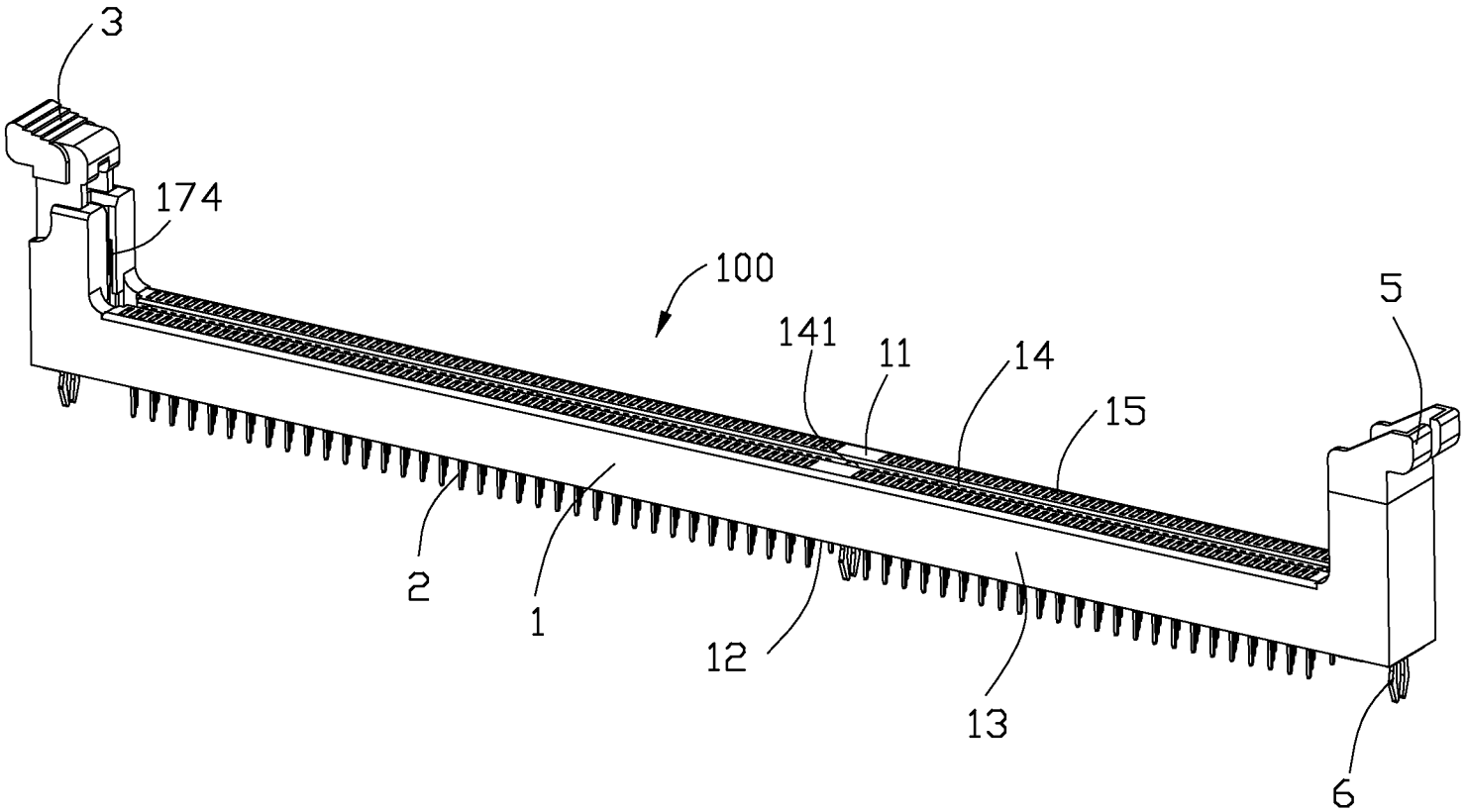
FIG. 1 is an assembled, perspective view of a card edge connector in a preferred embodiment according to present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
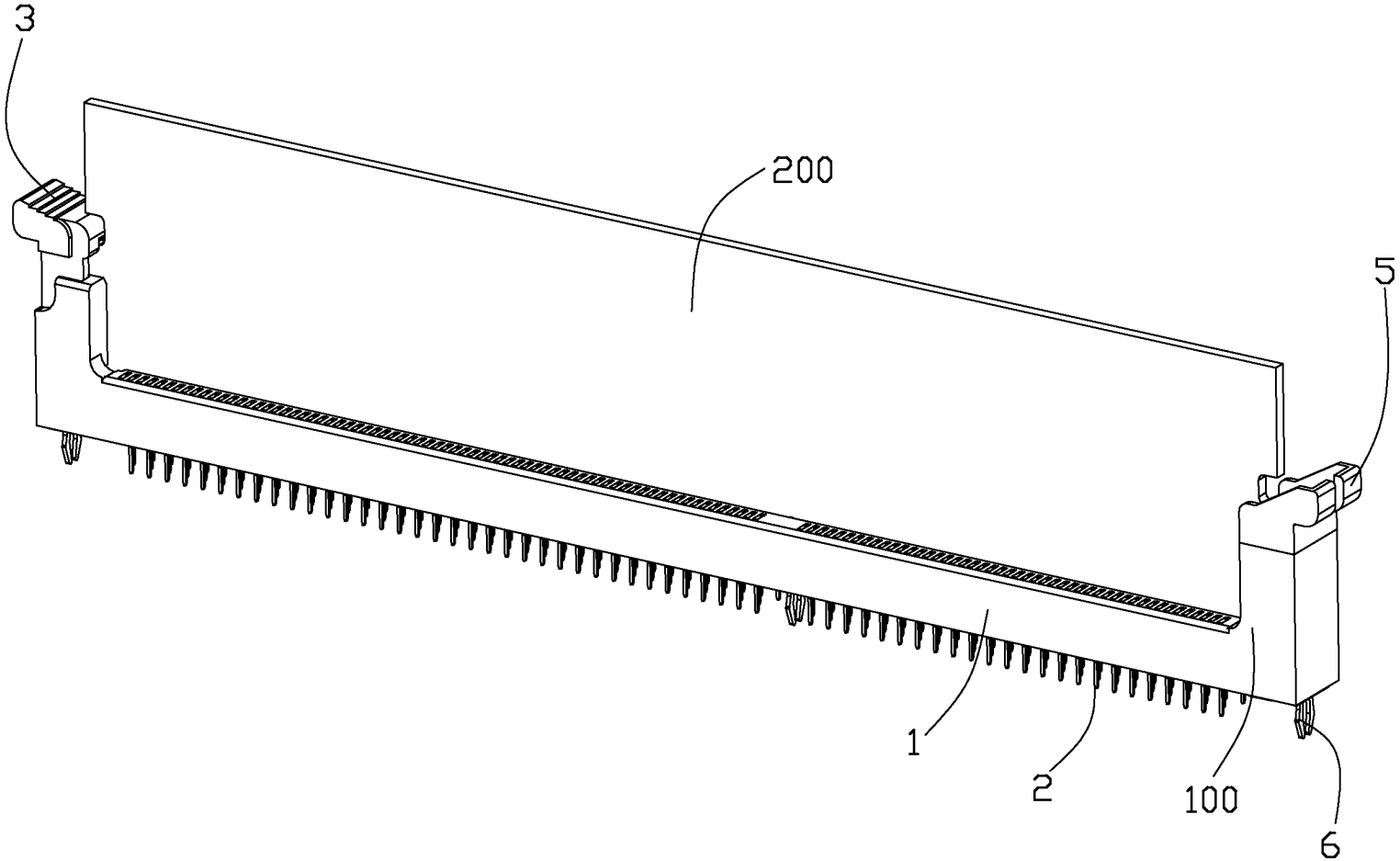
FIG. 2 is similar with FIG. 1, but a daughter card is inserted into the card edge connector.

Referring to FIG. 1-2, a card edge connector 100 in a preferred embodiment according to present invention is disclosed and adapted for accommodating an daughter card 200. The card edge connector 100 includes an insulative housing 1, a plurality of contacts 2 assembled to the insulative housing 1, an ejector 3 and a locking member 4 set on two ends of the insulative housing 1 to lock the daughter card 200 and a cap 5 assembled to the insulative housing and located above the locking member 4. The insulative housing 1 is equipped with board lockers 6 to latch with a printed circuit board (not shown). The daughter card 200 defines a locking notch 201 for engaging with the locking member 4.

Figure 3:
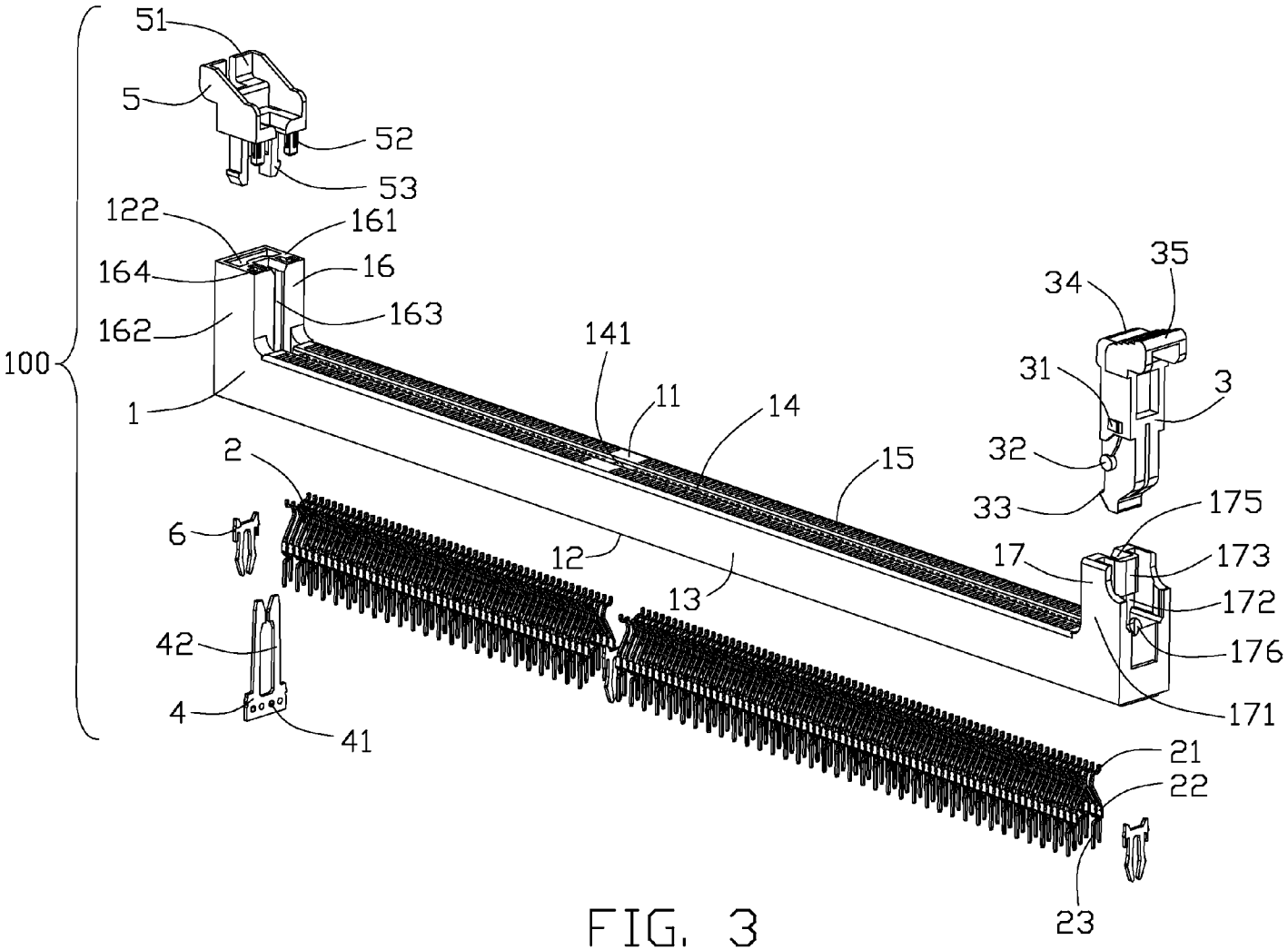
FIG. 3 is an explored, perspective view of the card edge connector.

Referring to FIG. 3, the insulative housing 1 extends in a longitudinal direction and includes a top surface 11, a bottom surface 12, two sidewalls 13 connecting the top surface 11 and the bottom surface 12, a central slot 14 defined by and between the two sidewalls 13 and extending along the longitudinal direction and a plurality of contact passageways 15 arranged on two inner sides of the central slot 14. The central slot 14 is divided into two different parts with different lengths by a key 141 so as to prevent the daughter card 200 from mismating.

Figure 4:
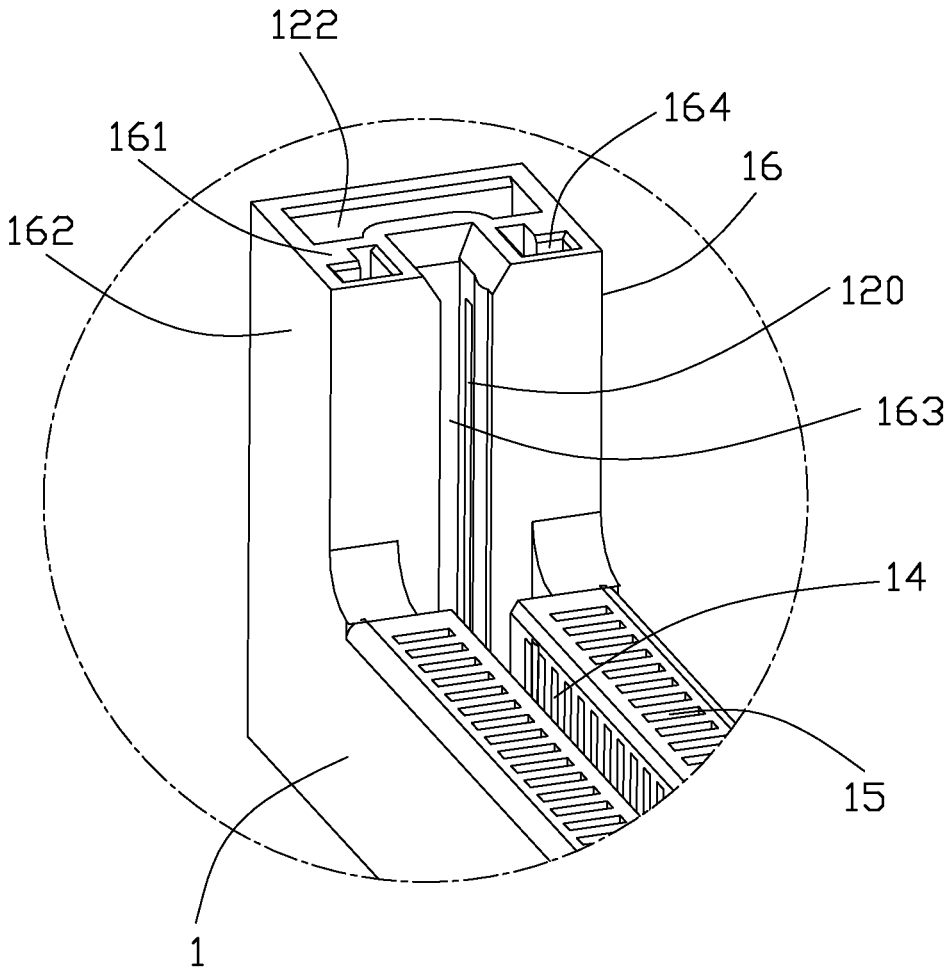
FIG. 4 is an enlarged, perspective view of a part of the card edge connector in FIG. 1.
Figure 5:
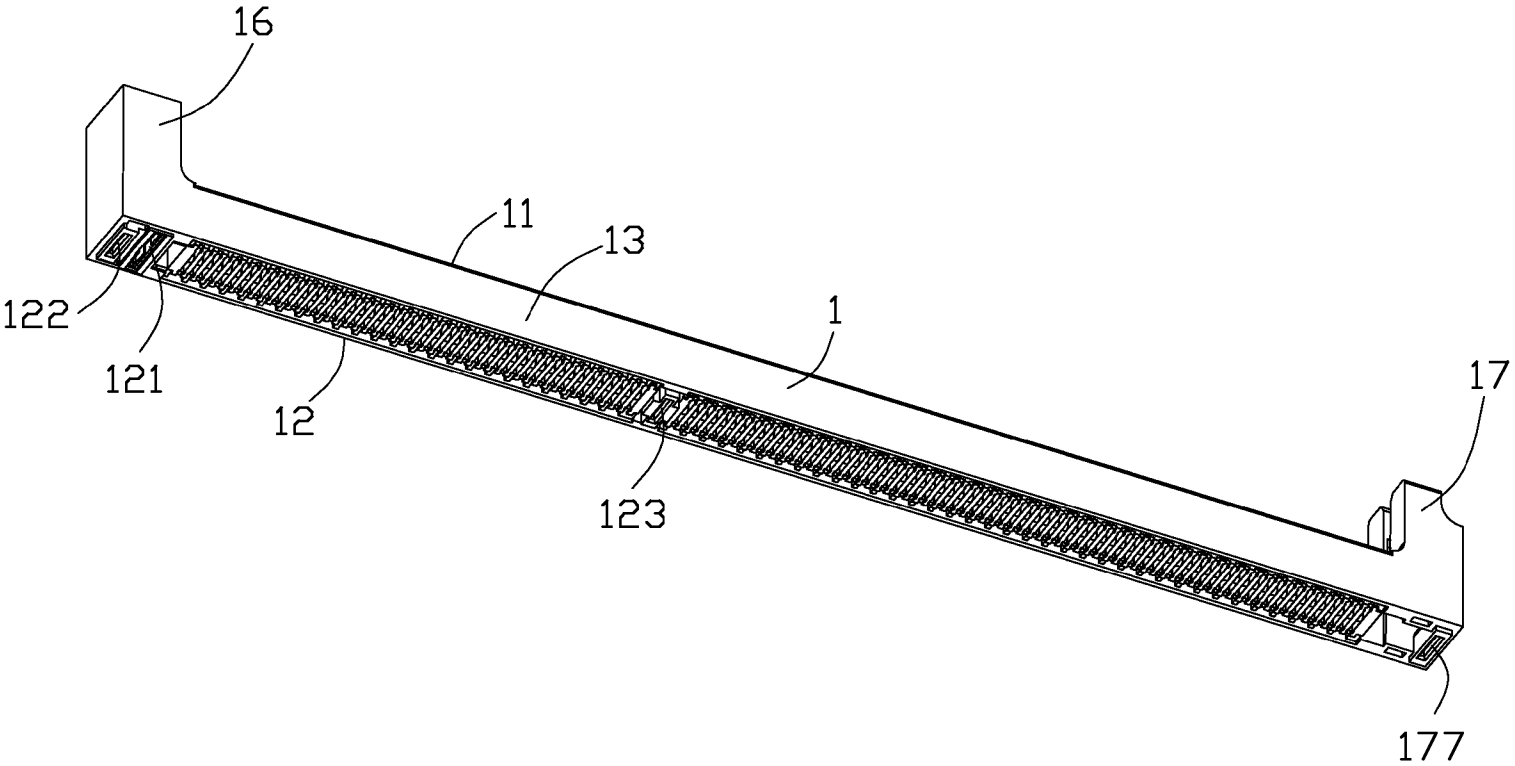
FIG. 5 is a perspective view of an insulative housing of the card edge connector.
Figure 6:
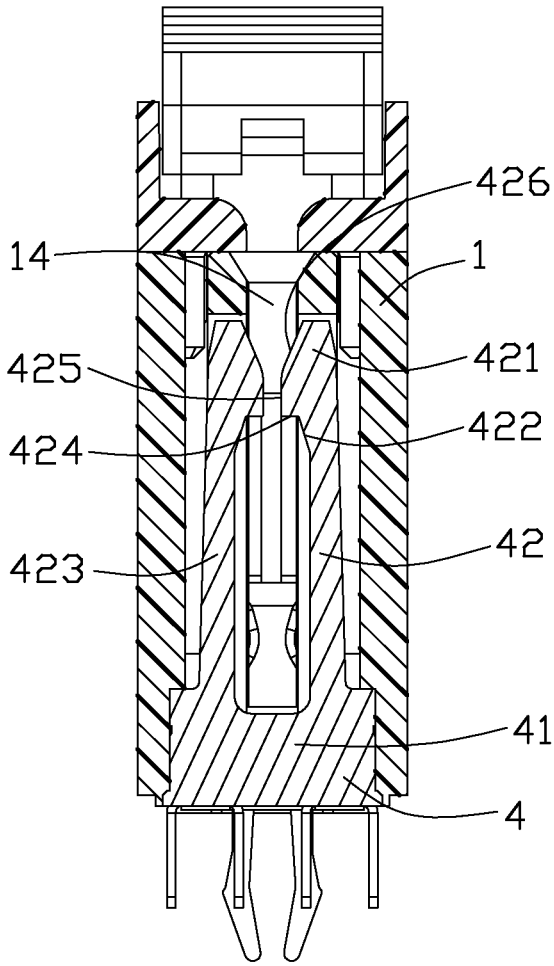
FIG. 6 is a sectional view of the card edge connector in FIG. 1, showing a locking member received in the insulative housing.

Conjoined with FIGS. 4-5, the insulative housing 1 is formed with two towers 16 and 17 on two opposite longitudinal ends of the insualtive housing 1 and protruding upwardly beyond the top surface 11 of the insulative housing 1. The first tower 16 has a top surface 161 on a top thereof and a peripheral wall 162 with a first guiding slot 163 defined on a side thereof facing the central slot 14. The first guiding slot 163 passes through the top surface 161 and communicates with the central slot 14 for accommodating an edge of the daughter card 200. The insulative housing 1 comprises a first mounting slot 121 for mounting the locking member 4, and a second mounting slot 122 for mounting the board locker 6, both the first and the second mounting slots 121, 122 are recessed from a bottom surface of the first tower 16 and spread along a transverse direction perpendicular to the longitudinal direction, seen from a top side. A third mounting slot 123 is defined on a position corresponding to the key 141 of the bottom surface 12 of the insulative housing 1 for receiving another board locker 6.

The second mounting slot 122 upwardly passes through the top surface 161 of the first tower 16. The first mounting slot 121 also upwardly extends near to but not through the top of first tower 16, the first tower 16 further defines two positioning slots 164 for positioning the cap 5. The first guiding slot 163 intersects the second mounting slot 122, the first mounting slot 121 is parallel to the second mounting slot 122 and nearer the central slot 14 than the second mounting slot 122, and the positioning slots 164 are located on two opposite sides of the first guiding slot 163 and aligned with the first guiding slot 163 along the transverse direction. The first mounting slot 121 runs through the peripheral wall 161 to define opening 120 communicating with the first guiding slot 163.

Referring to FIG. 3 and FIG. 5, and conjoined with FIG. 1, the second tower 17 has a peripheral wall 171 defining a receiving slot 172 therebetween to receive the ejector 3. A second guiding slot 174 is defined by U shaped guiding wall 173 with an opening communicating with the central slot 14 and opposite ends connecting with an upper side of the peripheral wall 171, observed from a top side, to guide another edge of the daughter card 200, and the guiding wall 173 is located on a top side of the receiving slot 172 and has a guiding surface 165 at a top thereof. The peripheral wall 171 defines two pivoting holes 176 on two inner surfaces of the receiving slot 172 to pivot the ejector 3. A forth mounting slot 177 is defined on a bottom surface of the second tower 17 to mounting another board locker 6.

Referring to FIG. 3, the contact 2 has a contact portion 21 extending from the contact passageways 15 to the central slot 14 to contact with the daughter card 200, a retaining portion 22 interfering with the insulative housing 1 to retain the contact 2 and a soldering leg 23 extending beyond the bottom surface 12 of the insulative housing 1 and bend outwardly then downwardly to be mounted on the printed circuit board.

The ejector 3 is received in the receiving slot 172 of the second tower 17. The ejector 3 has two clumps 31 and two pivots 32 on two sides thereof, the pivots 32 are assembled to the pivoting holes 176 of the insulative housing 1 to make the ejector 3 capable of rotating inwardly or outwardly toward the central slot 14. The ejector 3 has an inwardly protruding ejecting portion 33 on a bottom thereof to withdraw the daughter card 200 received in the central slot 14, and a locking portion 34 and an outwardly extending operating portion 35.

Conjoined with FIG. 6 to FIG. 9, the locking member 4 is a sheet of metal and assembled to the insulative housing 1 from a bottom side. The locking member 4 is a one-piece element, and comprises a retention portion 41 and a pair of elastic arms 42 extending upwardly from the retention portion 41. The retention portion 41 engages with a lower part of the first mounting slot 121 with a large dimension along the transverse direction to retain the locking member 4 onto the insulative housing 1, and the elastic arms 42 are located with an upper part of the first mounting slot 121 with a small dimension and deflectable within the first mounting slot 121. The elastic arm 42 comprises a locking portion 421 for locking with the daughter card 200, and a supporting surface 422 below the locking portion 421 to prevent the daughter card 200 from swinging in the transverse direction. The elastic arm 42 are symmetrically located on two opposite sides of the central slot 14 along the transverse direction, and deflects outwardly when being pushed by the daughter card 200 in insertion and then returns back to protrude into and lock with the locking notch 201 when the locking notch 201 is aligned with the elastic arm 42. The supporting surface 422 abuts against the daughter card 200 in the transverse direction to hold the daughter card 200. The elastic arm 42 has a vertical arm 423 connecting the locking portion 421 and the retention portion 41. The supporting surface 422 is an inclined surface.

The locking portion 421 further has a pressing surface 424 at a bottom thereof for downwardly pressing the daughter card 200 when the daughter card 200 received in the central slot 14 moves upwardly so as to prevent the daughter card 200 swing in a top-to-bottom direction. The supporting surface 422 connects the pressing surface 424 and the locking portion 421. Each elastic arm 42 has an abutting surface 425 abutting against a side surface 202 of the daughter card 200 during an insertion process of the daughter card 200, and a gap between the two abutting surfaces 425 of the two elastic arms 42 is smaller than a thickness of the daughter card 200. Each elastic arm 42 has a guiding face 426 at a top of the locking portion 421 to guide the insertion of the daughter card 200. The retention portion 41 is formed with barbs 411 and upright edges 412, both the barbs 411 and the upright edges 412 interfere with insulative housing 1 to reliably retain the locking member 4 in the first mounting slot 121.

Referring to FIG. 3, the cap 5 has a main body 51 and a first positioning post 52 and a second positing post 53 downwardly extending from the main body 51, the first positing post 52 is mounted within the positing hole 164, and the second positing post 53 is mounted within the second mounting slot 122.

Figure 7:
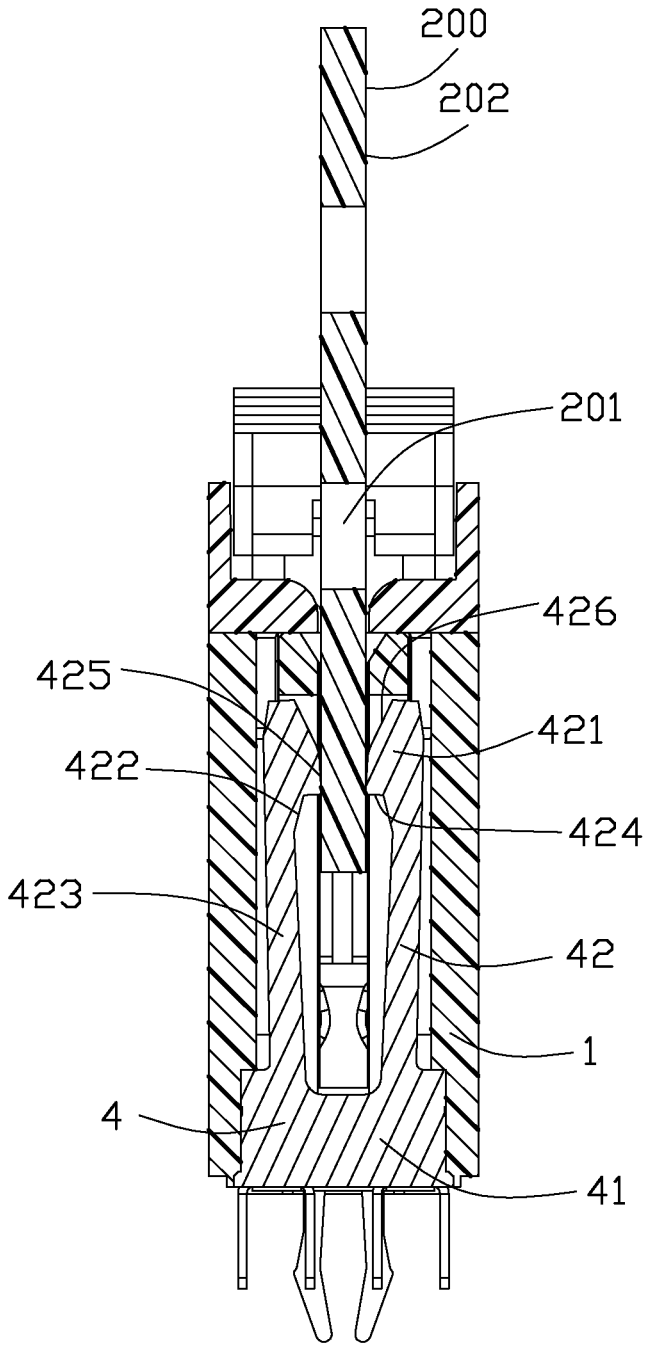
FIG. 7 is similar with FIG. 6, but shows the daughter card inserting into the card edge connector.
Figure 8:
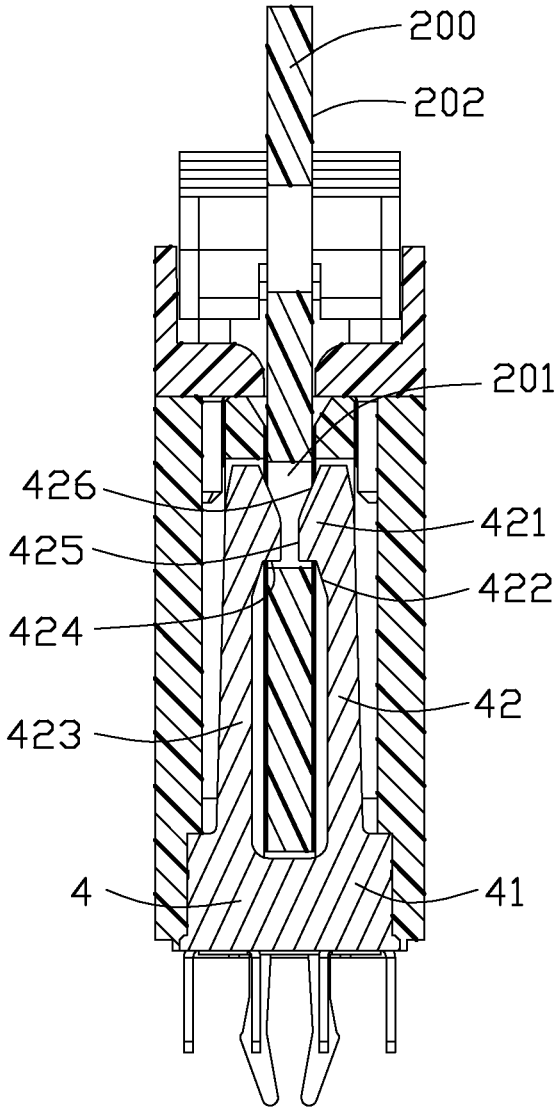
FIG. 8 is similar with FIG. 7, but the daughter card is completely received in the card edge connector.
Figure 9:
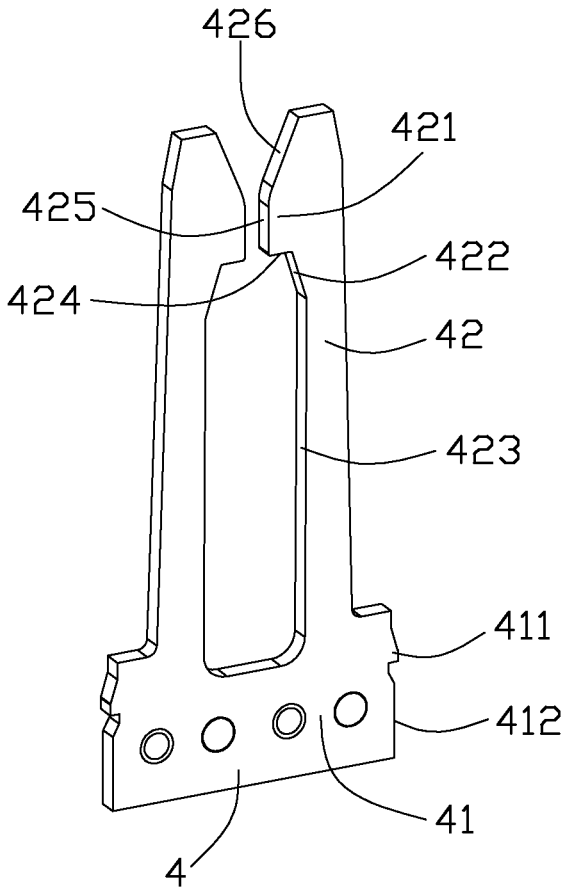
FIG. 9 is a perspective view of the locking member of the card edge connector.

Referring to FIG. 7 and FIG. 8, during an insertion of the daughter card 200 into the insulative housing 1, a front end of the daughter card 200 presses the guiding face 426 and pushes the elastic arm 42 outwardly, after a front end passes through the guiding face 426, the side surface 202 abuts against the abutting surface 425, and the elastic arm 42 continues to deflect outwardly; and when the daughter card 200 arrives its final position, the elastic arm 42 returns back by its resiliency and are received in the locking notch 201 to lock the daughter card 200. At this status, the daughter card 200 defines a minor gap between the pressing surface 424 and the supporting face 422, respectively, to avoid the daughter card 200 directly conflict the locking member 4. The pressing surface 424 can prevent the daughter card 200 from being pulled upwardly, and the supporting face 422 can prevent the daughter card 200 from swing in the transverse direction. So the daughter card 200 is reliably locked in the card edge connector 100.

Figure 10:
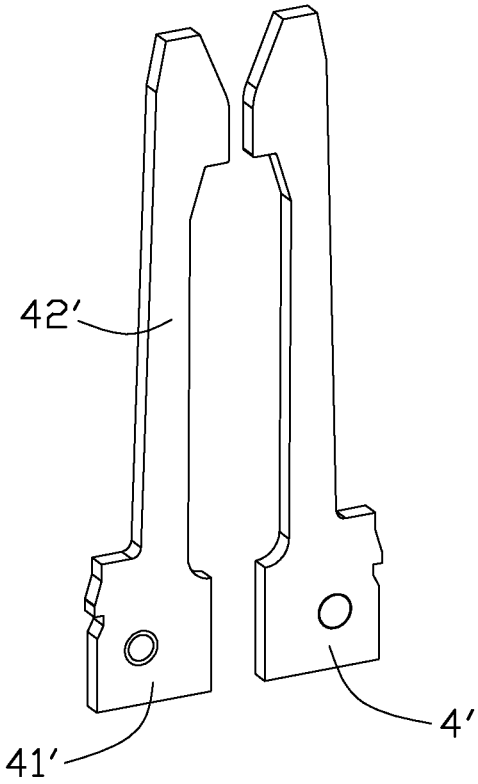
FIG. 10 is a perspective view of an alternative locking member of the card edge connector.

FIG. 10 shows another alternative locking member 4' for the card edge connector 1, the locking member 4' similar with the locking member 4 except that the locking member 4' is a two-piece element, that means the locking member 4' is divided into two parts, and each part has a retention portion 41' and a elastic arm 42' extending upwardly from the retention portion 41'. Corresponding modification is needed to the first mounting slot 121, here will not give unnecessary details.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, adapted for receiving a daughter card with a locking notch, comprising:

a longitudinal insulative housing defining a central slot for receiving the daughter card and having two towers located on two longitudinal ends of the insulative housing;

a plurality of contacts retained into the insulative housing and having contact portions protruding into the central slot;

an ejector assembled to one tower of the insulative housing and having an ejecting portion for withdrawing the daughter card received in the central slot; and a locking member set on the other one tower, the locking member formed with a retention portion interfering with the insulative housing and a pair of elastic arms extending upwardly from the retention portion and symmetrically located on two opposite sides of the central slot along a transverse direction perpendicular to longitudinal direction, each elastic arm having a locking portion protruding toward each other, and a gap between the locking portions being smaller than a thickness of the daughter card, wherein the elastic arm has a vertical arm connecting the locking portion and the retention portion, the elastic arm further has a supporting surface below the locking portion and is an inclined surface.

2. The card edge connector as claimed in claim 1, wherein the insulative housing defines a first mounting slot which passes through a bottom surface of the other one tower and extends upwardly but not through a top surface of the other one tower.

3. The card edge connector as claimed in claim 2, wherein the supporting surface can support the daughter card in the transverse direction to prevent the daughter card from swinging in the transverse direction.

4. The card edge connector as claimed in claim 3, wherein the locking portion further has a pressing surface connecting with the supporting surface for downwardly pressing the daughter card when the daughter card received in the central slot moves upwardly so as to prevent the daughter card from swinging in a top-to-bottom direction.

5. The card edge connector as claimed in claim 4, wherein each elastic arm has an abutting surface abutting against a lateral side surface of the daughter card during an insertion process of the daughter card.

6. The card edge connector as claimed in claim 5, wherein the elastic arm is deflectable outwardly in the first mounting slot along the transverse direction.

7. The card edge connector as claimed in claim 6, wherein the one tower has a peripheral wall defining a receiving slot therebetween, and the ejector is pivotally assembled to the receiving slot.

8. The card edge connector as claimed in claim 7, wherein the locking member is a sheet of metal, and is a one-piece element or a two-piece element.

9. The card edge connector as claimed in claim 8, further comprising a cap assembled to the other one tower above the locking member, the cap has a main body and a first positioning post and a second positing post downwardly extending from the main body, the first positing post is mounted within a positing hole defined on the other one tower, and the second positing post latches with a second mounting slot defined on the other one tower.

10. A card edge connector for mating with a corresponding daughter card with a locking notch at a side thereof, comprising:

an insulative housing with a plurality of contacts, the insulative housing extending along a longitudinal direction and defining a central slot for receiving the daughter card;

a locking member set on one longitudinal end of the insulative housing, the locking member being a one-piece element and formed with a retention portion to retain the locking member to the insulative housing and a pair of elastic arms extending upwardly from the retention portion and symmetrically located on two opposite sides of the central slot along a transverse direction perpendicular to longitudinal direction, each elastic arm having a locking portion protruding toward each other for latching with the locking notch of the daughter card, wherein the insulative housing comprises a first mounting slot, the retention portion has a one piece-shape and is formed with barbs interfering with the first mounting slot to reliably retain the locking member in the first mounting slot.

11. The card edge connector as claimed in claim 10, wherein the first mounting slot has a lower part with a large dimension along the transverse direction, the lower part engages with the retention portion to prevents the retention portion from moving upwardly.

12. The card edge connector as claimed in claim 10, wherein the elastic arm has a vertical arm connecting the locking portion and the retention portion and being deflectable, the locking portion has a pressing surface on a bottom thereof, an inner surface of the vertical arm connecting with of pressing surface of the locking portion is an inclined supporting surface.

13. The card edge connector as claimed in claim 12, further comprising a cap assembled to the insulative housing and located above the locking member, the cap has a main body and first positioning posts and second positing posts downwardly extending from the main body, both the first positing posts and the second positing posts are positioned in corresponding slots defined on the insulative housing.

14. The card edge connector as claimed in claim 13, further comprising an ejector assembled to the other longitudinal end of the insulative housing and having an ejecting portion for withdrawing the daughter card received in the insulative housing.

15. A card edge connector for use with a memory module having upper and lower notches in each of two opposite side edges, comprising:

an insulative housing defining an elongated receiving slot along a lengthwise direction and a pair of towers at two opposite ends;

a plurality of contacts disposed in the housing by two sides of the receiving slot;

a ejector pivotally mounted to one of the pair of towers with an upper locker exposed above the tower for locking into the upper notch in one of the two opposite side edges and a lower kicker moveable in the receiving slot for ejecting a bottom section adjacent to said one of the two opposite side edges; and a planar metallic locking member assembled to the other of the pair of towers and being configured with and derived from a sheet of metal defining a thickness with thereof a corresponding thickness direction being same with said lengthwise direction, said locking member including a pair of opposite resilient locking arms protectively hidden a top face of the other of the pair of towers and coplanarly and symmetrically located on said two sides of the receiving slot with corresponding locking heads simultaneously invading the lower notch of the other of the two opposite side edges in a coplanar manner; wherein the memory module experiences asymmetrical retention and ejection with regard to the connector.

16. The card edge connector as claimed in claim 15, wherein the pair of opposite resilient locking arms are unified with each other via a lower retention portion of said locking member.

17. The card edge connector as claimed in claim 15, wherein said planar metallic locking member is directly stamped from said sheet of metal and not further bent after being stamped from the said sheet of metal.

* * * * *